US009419397B2

(12) United States Patent
Wu

(10) Patent No.: US 9,419,397 B2
(45) Date of Patent: Aug. 16, 2016

(54) 360 DEGREE ROTATABLE PLUG

(71) Applicant: WELL SHIN TECHNOLOGY CO., LTD., Taipei (TW)

(72) Inventor: Jui Hsiung Wu, Taipei (TW)

(73) Assignee: WELL SHIN TECHNOLOGY CO., LTD., Taipei (TW)

( * ) Notice: Subject to any disclaimer, the term of this patent is extended or adjusted under 35 U.S.C. 154(b) by 46 days.

(21) Appl. No.: 14/575,350

(22) Filed: Dec. 18, 2014

(65) Prior Publication Data

US 2016/0181753 A1 Jun. 23, 2016

(51) Int. Cl.
*H01R 35/04* (2006.01)
*H01R 39/64* (2006.01)

(52) U.S. Cl.
CPC ..... *H01R 39/64* (2013.01); *H01R 35/04* (2013.01)

(58) Field of Classification Search
CPC ..... H01R 36/04
USPC ..... 439/20, 13
See application file for complete search history.

(56) References Cited

U.S. PATENT DOCUMENTS 7,255,568 B1 * 8/2007 Wu ..... B60C 19/002 439/23
2008/0261430 A1 * 10/2008 Wadsworth ..... H01R 35/04 439/295

* cited by examiner

*Primary Examiner* — Abdullah Riyami
*Assistant Examiner* — Justin Kratt
(74) *Attorney, Agent, or Firm* — WPAT, P.C., Intellectual Property Attorneys; Anthony King

(57) ABSTRACT

A rotatable plug includes an upper cover, a dynamic rotatable unit, a static rotatable unit pivotally mounted to a bottom of the dynamic rotatable unit, a connecting cable fastened to the static rotatable unit, and a lower cover. The dynamic rotatable unit includes a plurality of dynamic conductive tubes of which each has a rotatable ring. The static rotatable unit includes a plurality of static conductive tubes of which each has a ring body. The rotatable ring is disposed around and is electrically connected with the ring body. The upper cover, the static rotatable unit and the lower cover are capable of rotating 360 degrees along a traction direction of the connecting cable, and the upper cover, the static rotatable unit, the lower cover and the connecting cable are capable of proceeding the same angle rotation.

13 Claims, 10 Drawing Sheets

360 DEGREE ROTATABLE PLUG

BACKGROUND OF THE INVENTION

1. Field of the Invention

The present invention generally relates to a plug, and more particularly to a rotatable plug.

2. The Related Art

Nowadays, electronic equipments are widely used in people's daily production and lives. In order to provide power for the electronic equipment, a plug connected with one end of a connecting cable is needed, wherein the other end of the connecting cable is electrically connected with the electronic equipment. In use, the plug is inserted into a socket for realizing a connection between the electronic equipment and a power supply. After the plug is inserted into the socket, because the socket is immovable, the plug is fastened to the socket. In order to achieve a use convenience, the electronic equipment is often moved, so the connecting cable of the plug often needs to be twisted.

However, because the connecting cable of the plug often needs to be twisted, and the plug hardly rotates along the traction direction of the connecting cable, the connecting cable is easily damaged and even broken down to cause a phenomenon of leaking electricity, short circuit or open circuit of the connecting cable. As a result, an electrical performance stability and a use convenience of the plug are affected.

So in order to satisfy the need of the people's daily production and lives, it's essential to provide a rotatable plug which is facilitate for the electrical performance stability and the use convenience.

SUMMARY OF THE INVENTION

An object of the present invention is to provide a rotatable plug. The rotatable plug includes an upper cover, a dynamic rotatable unit, a static rotatable unit, a connecting cable and a lower cover. The upper cover includes a top board. A front end of the top board defines an opening vertically penetrating through the front end of the top board. The dynamic rotatable unit includes a terminal board, a plurality of conductive pins and a plurality of dynamic conductive tubes. The conductive pins are fastened to the terminal board, and top ends of the conductive pins project beyond a top of the terminal board. The dynamic conductive tubes are fastened to a bottom of the terminal board and are spaced from one another. Each of the dynamic conductive tubes has a rotatable ring. A bottom end of each of the conductive pins projects under the bottom of the terminal board and is fastened to a bottom of one end of one of the dynamic conductive tubes. The static rotatable unit is pivotally mounted to a bottom of the dynamic rotatable unit. The static rotatable unit includes a base and a plurality of static conductive tubes. The static conductive tubes are fastened to the base and are spaced from one another. Each of the static conductive tubes has a ring body. The rotatable ring of each of the dynamic conductive tubes is disposed around and is electrically connected with the ring body of one of the static conductive tubes. The connecting cable is fastened to the static rotatable unit. The upper cover is covered on the dynamic rotatable unit, the static rotatable unit and the connecting cable. The top ends of the conductive pins are exposed out of the upper cover through the opening. The lower cover is fastened under the upper cover to make the dynamic rotatable unit, the static rotatable unit and a front end of the connecting cable fastened between the upper cover and the lower cover. A rear end of the connecting cable projects out of the upper cover and the lower cover. The upper cover, the static rotatable unit and the lower cover are capable of rotating 360 degrees along a fraction direction of the connecting cable, and the upper cover, the static rotatable unit, the lower cover and the connecting cable are capable of proceeding the same angle rotation.

As described above, the upper cover, the static rotatable unit, the lower cover and the clamping assembly are capable of rotating 360 degrees along the traction direction of the connecting cable, and the upper cover, the static rotatable unit, the lower cover, the clamping assembly and the connecting cable are capable of proceeding the same angle rotation. So that it's easier to keep the connecting cable connected with the static rotatable unit in good shape for ensuring an electrical performance stability and a usage convenience of the rotatable plug.

BRIEF DESCRIPTION OF THE DRAWINGS

The present invention will be apparent to those skilled in the art by reading the following description, with reference to the attached drawings, in which:

FIG. 4 is an exploded view of a dynamic rotatable unit of the rotatable plug of

FIG. 3;

DETAILED DESCRIPTION OF THE PREFERRED EMBODIMENT

Figure 1:
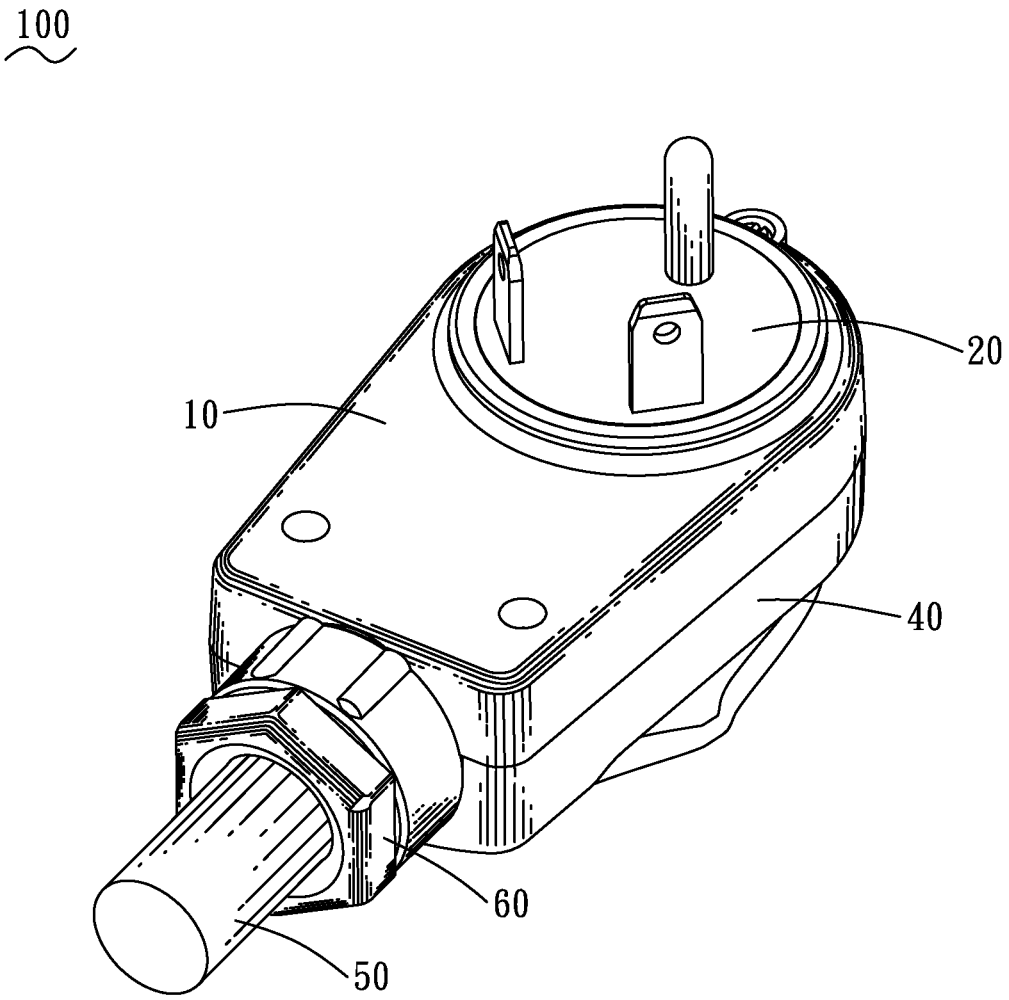
FIG. 1 is a perspective view of a rotatable plug in accordance with an embodiment of the present invention.
Figure 2:
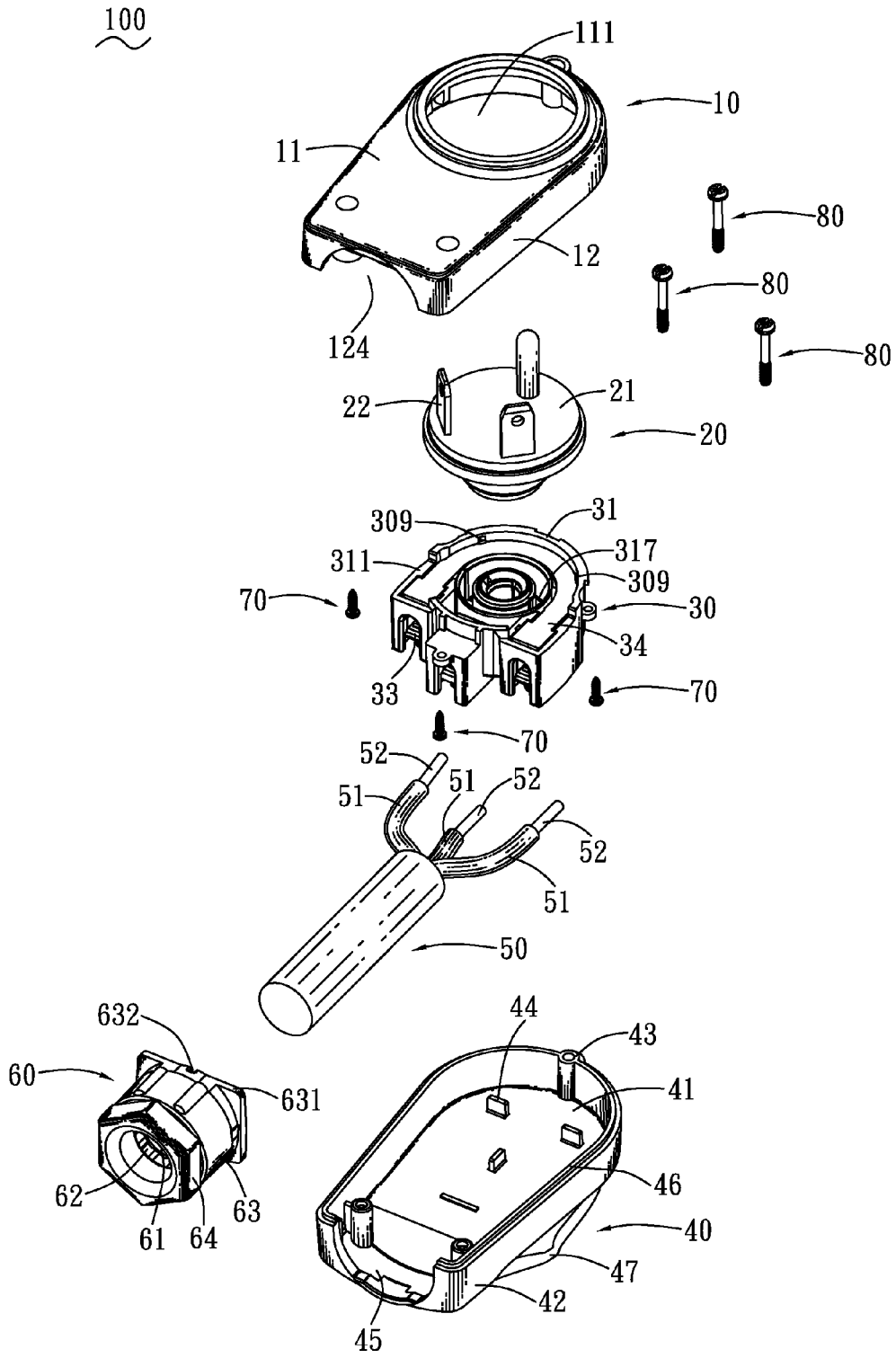
FIG. 2 is an exploded view of the rotatable plug of FIG. 1.

Referring to FIG. 1 and FIG. 2, a rotatable plug 100 in accordance with an embodiment of the present invention is shown. The rotatable plug 100 includes an upper cover 10, a dynamic rotatable unit 20, a static rotatable unit 30, a connecting cable 50, a lower cover 40 and a clamping assembly 60.

Figure 3:
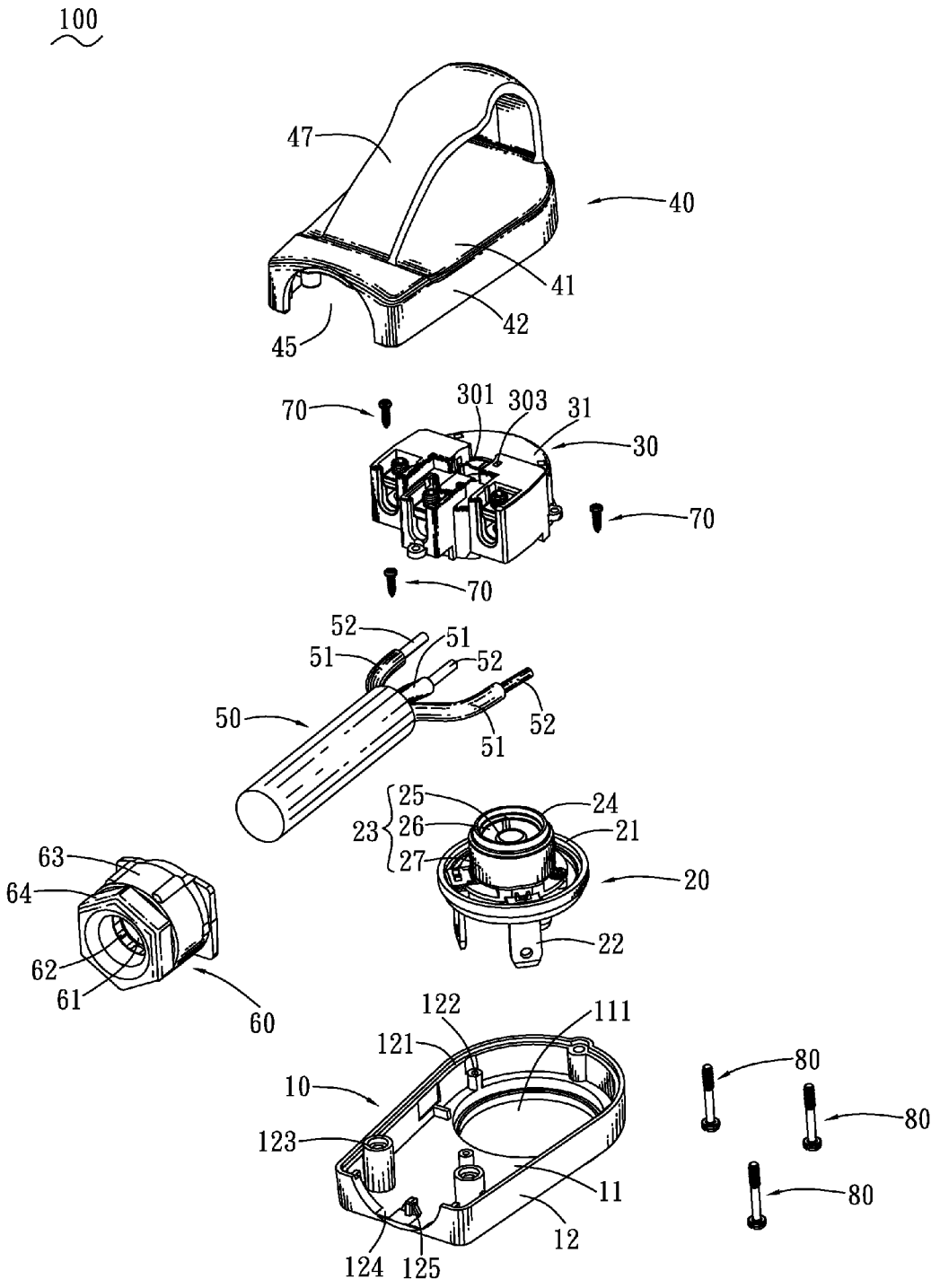
FIG. 3 is another exploded view of the rotatable plug of FIG. 1.

Referring to FIG. 1, FIG. 2 and FIG. 3, the upper cover 10 includes a top board 11 and a first blocking wall 12 protruded downward from a periphery of the top board 11. A front end of the top board 11 defines an opening 111 vertically penetrating through the front end of the top board 11. An inner periphery of a bottom of the first blocking wall 12 is recessed inward to form a blocking groove 121. Several portions of a bottom surface of the top board 11 protrude downward to form a plurality of hollow-shaped first fastening pillars 122 and second fastening pillars 123 arranged at intervals. A bottom of a rear end of the first blocking wall 12 is recessed inward to form a first recess 124. A junction between a top sidewall of the first recess 124 and the bottom surface of the top board 11 protrudes downward to form a cross-shaped restricting block 125.

Figure 4:
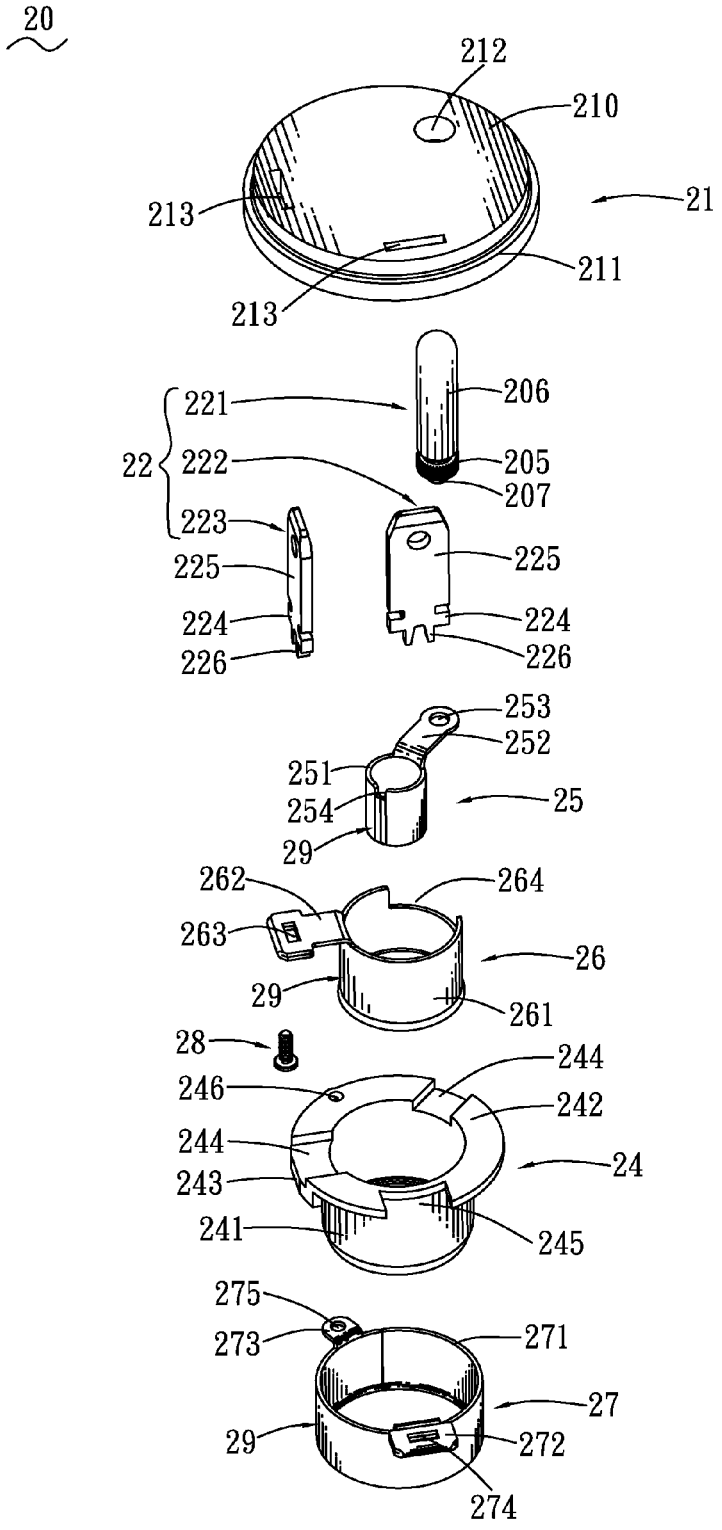

Referring to FIG. 2, FIG. 3 and FIG. 4, the dynamic rotatable unit 20 includes a terminal board 21, a plurality of conductive pins 22, a plurality of dynamic conductive tubes 23, an isolating ring 24 and a first fastening element 28. The conductive pins 22 include a ground wire pin 221, a neutral wire pin 222 and a live wire pin 223. The dynamic conductive tubes 23 include a dynamic conductive tube of ground wire 25, a dynamic conductive tube of neutral wire 26 and a dynamic conductive tube of live wire 27.

Referring to FIG. 2, FIG. 3, FIG. 4 and FIG. 8, the terminal board 21 has a circular first main board 210, and a ring-shaped blocking portion 211 protruded downward from a periphery of the first main board 210. A front end of a bottom surface of the first main board 210 protrudes downward to form a protruding pillar 201. Two opposite sides of a rear end of the bottom surface of the first main board 210 protrude downward to form two rectangular protruding blocks 202. The terminal board 21 defines a circular first insertion hole 212 vertically penetrating through the protruding pillar 201 and the first main board 210, and two rectangular second insertion holes 213 respectively penetrating through the protruding blocks 202 and the first main board 210 vertically. A middle of the bottom surface of the first main board 210 protrudes downward to form a hollow-shaped first supporting column 214, and a semicircular-shaped first supporting portion 215 disposed around and spaced from the first supporting column 214. The first supporting portion 215 is spaced from the protruding pillar 201 and the two protruding blocks 202. A front end of the first supporting portion 215 is cut off to form a gap 203.

Referring to FIG. 2, FIG. 3, FIG. 4 and FIG. 8, two opposite sides and a rear end of the first supporting column 214 protrude outward to form a plurality of guiding pillars 204 extending vertically. An upper portion of one of the guiding pillars 204 located at the rear end of the first supporting column 214 protrudes outward to form a first bearing portion 216. Two free ends of an outside of the first supporting portion 215 protrude outward to form two first abutting portions 217. Two portions of the outside of the first supporting portion 215 protrude outward to form two second bearing portions 218. One of the second bearing portions 218 is connected with one of the first abutting portions 217, and the other second bearing portion 218 is located adjacent to and spaced from the other first abutting portion 217. One side of the bottom surface of the first main board 210 protrudes downward to form a hollow-shaped locating pillar 219.

Referring to FIG. 2 and FIG. 4, the ground wire pin 221 has a first fastening portion 205, a cylindrical first insertion portion 206 protruded upward and then extended outward from a top end of the first fastening portion 205, and a first contact portion 207 protruded downward from a middle of a bottom end of the first fastening portion 205. The neutral wire pin 222 and the live wire pin 223 have the same structure. The neutral wire pin 222 and the live wire pin 223 respectively have an elongated second fastening portion 224, a second insertion portion 225 extended upward from a top end of the second fastening portion 224, and two second contact portions 226 protruded downward from two opposite sides of a bottom end of the second fastening portion 224.

Referring to FIG. 2 and FIG. 4, each of the dynamic conductive tubes 23 has a rotatable ring 29. The dynamic conductive tube of ground wire 25 has a first rotatable ring 251, and a first connecting piece 252 extended outward from a top periphery of the first rotatable ring 251. The first connecting piece 252 opens a first connecting hole 253. A rear end of the top periphery of the first rotatable ring 251 is recessed downward to form a first lacking groove 254.

Referring to FIG. 2 and FIG. 4, the dynamic conductive tube of neutral wire 26 has a second rotatable ring 261, and a second connecting piece 262 extended outward from one side of a rear end of a top periphery of the second rotatable ring 261. The second connecting piece 262 opens a second connecting hole 263. A front end of a top periphery of the second rotatable ring 261 is recessed downward to form a second lacking groove 264.

Referring to FIG. 2 and FIG. 4, the dynamic conductive tube of live wire 27 has a third rotatable ring 271, a third connecting piece 272 extended outward from one side of a rear end of a top periphery of the third rotatable ring 271, and a fourth connecting piece 273 extended outward from the other side of the rear end of the top periphery of the third rotatable ring 271. The third connecting piece 272 opens a third connecting hole 274. The fourth connecting piece 273 opens a fourth connecting hole 275.

Referring to FIG. 2 and FIG. 4, the isolating ring 24 has a ring-shaped main body 241, and a semicircular locating piece 242 protruded outward from a top edge of the main body 241. Two opposite sides of the locating piece 242 protrude downward to form two holding portions 243. A top surface of each of the holding portions 243 is concaved downward to form a holding groove 244. A locating groove 245 is formed between two free ends of the locating piece 242. The locating piece 242 opens a locating hole 246.

Figure 5:
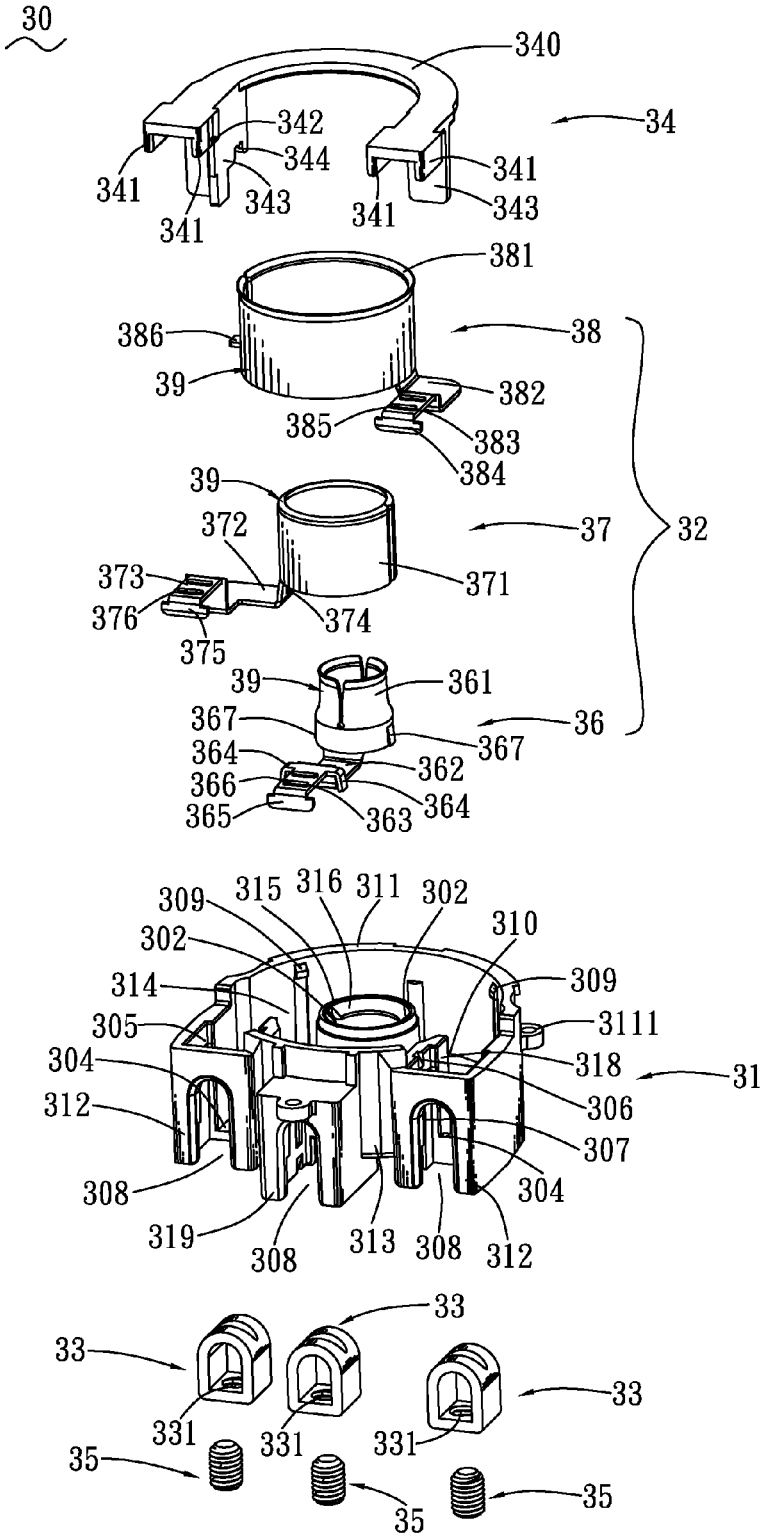
FIG. 5 is an exploded view of a static rotatable unit of the rotatable plug of FIG. 3.

Referring to FIG. 2, FIG. 3 and FIG. 5, the static rotatable unit 30 includes a base 31, a plurality of static conductive tubes 32, a plurality of hollow-shaped wire clamps 33, a sealing element 34 and a plurality of locking elements 35. The static conductive tubes 32 include a static conductive tube of ground wire 36, a static conductive tube of neutral wire 37 and a static conductive tube of live wire 38.

Referring to FIG. 2, FIG. 3, FIG. 5 and FIG. 9, the base 31 has a semicircular second main board 310, a semicircular surrounding wall 311 protruded upward from a periphery of the second main board 310, two rear walls 312 protruded upward from two opposite sides of a rear end of the second main board 310, and an arc-shaped connecting wall 313 connecting between the two rear walls 312 and projecting beyond top surfaces of the two rear walls 312 and a rear end of the surrounding wall 311. The second main board 310, the surrounding wall 311, the two rear walls 312 and the connecting wall 313 surround an accommodating space 314 thereamong. A middle of the second main board 310 opens a fastening hole 301.

A periphery of a sidewall of the fastening hole 301 protrudes upward to form a cylindrical second supporting ring 315. A middle of the second supporting ring 315 is corresponding to the fastening hole 301. A top of an inner periphery of the second supporting ring 315 protrudes inward to form a ring-shaped third abutting portion 316. Two opposite sides of the inner periphery of the second supporting ring 315 are recessed oppositely to form two buckling grooves 302 vertically penetrating through two opposite sides of the third abutting portion 316. One side of a bottom end of an outer periphery of the second supporting ring 315 opens a fastening groove 303. A front end and a rear end of the second main board 310 protrude upward to form two second supporting portions 317 respectively located in front of and behind the second supporting ring 315.

Referring to FIG. 2, FIG. 3, FIG. 5 and FIG. 9, two opposite sides of the second main board 310 are concaved downward and extend towards the second supporting ring 315 to form two assembling grooves 304. Two junctions respectively between the two rear walls 312 and two opposite sides of the connecting wall 313 extend forward and downward to form two isolating boards 318 connecting with two bottom sidewalls of the two assembling grooves 304. Two inner surfaces of two free ends of the surrounding wall 311 are recessed oppositely to form two restraining grooves 305. Two tops of two side surfaces of the two isolating boards 318 respectively facing to the two restraining grooves 305 are recessed inward to form two guiding grooves 306. Two bottoms of the two side surfaces of the two isolating boards 318 facing to the two restraining grooves 305 are recessed inward to form two guiding channels 307. The two guiding grooves 306 are respectively in alignment with the two guiding channels 307.

A junction between the second main board 310 and the connecting wall 313 is connected with a fastening block 319. A rear end of the base 31 defines a plurality of receiving grooves 308. One of the receiving grooves 308 penetrates through a bottom and a front of the fastening block 319. The other two receiving grooves 308 respectively penetrate through two opposite sides of the second main board 310 and two middles of the two rear walls 312, and communicated with the two assembling grooves 304. Two opposite sides of a top of an inner periphery of the surrounding wall 311 protrude inward to form two limiting blocks 309. Two opposite sides of the surrounding wall 311 and a rear end of the fastening block 319 protrude outward to form a plurality of fastening rings 3111. A front end of the surrounding wall 311 projects beyond a top surface of a rear end of the surrounding wall 311. The top surface of the connecting wall 313 is flush with a top surface of the front end of the surrounding wall 311.

Referring to FIG. 2, FIG. 4 and FIG. 5, each of the static conductive tubes 32 has a ring body 39. The rotatable ring 29 of each of the dynamic conductive tubes 23 is disposed around and is electrically connected with the ring body 39 of one of the static conductive tubes 32. The static conductive tube of ground wire 36 has a first ring body 361, a U-shaped first connecting arm 362 connecting with a rear end of a bottom periphery of the first ring body 361, and a first contact arm 363 extended rearward from a free end of the first connecting arm 362. Two opposite sides of a front end of the first contact arm 363 extend downward to form two first fastening arms 364. A rear end of the first contact arm 363 is bent downward to form a first blocking arm 365. Two portions of a top surface of the first contact arm 363 protrude upward to form two first touching points 366. Two opposite sides of the first ring body 361 are punched outward to form two buckling portions 367.

Referring to FIG. 2 and FIG. 5, the static conductive tube of neutral wire 37 has a second ring body 371, a second connecting arm 372 extended downward, then extended outward, and further bent rearward and extended upward from one side of a bottom periphery of the second ring body 371, and a second contact arm 373 extended rearward from a free end of the second connecting arm 372. One end of the second connecting arm 372 adjacent to the second ring body 371 is punched inward to form a second fastening arm 374. A free end of the second contact arm 373 protrudes downward to form a second blocking arm 375. Two portions of a top surface of the second contact arm 373 protrude upward to form two second touching points 376.

Referring to FIG. 2 and FIG. 5, the static conductive tube of live wire 38 has a third ring body 381, a third connecting arm 382 extended downward and outward, then bent rearward, and further extended upward from one side of a bottom periphery of the third ring body 381, and a third contact arm 383 extended rearward from a free end of the third connecting arm 382. A free end of the third contact arm 383 protrudes downward to form a third blocking arm 384. Two portions of a top surface of the third contact arm 383 protrude upward to form two third touching points 385. The other side of the bottom periphery of the third ring body 381 is bent outward to form a fixing arm 386.

Referring to FIG. 2 and FIG. 5, each of the wire clamps 33 shows a hollow shape with a front and a rear being opened freely. A bottom of each of the wire clamps 33 opens a locking hole 331. The sealing element 34 has a U-shaped sealing portion 340 with the mouth thereof facing rearward. Two opposite sides of each free end of the sealing portion 340 protrude downward to form two restraining portions 341. Two facing surfaces of the two restraining portions 341 of the two free ends of the sealing portion 340 protrude face to face to form two guiding portions 342. A bottom of each free end of the sealing portion 340 extends downward to form a limiting portion 343 located behind the two restraining portions 341. A bottom of the limiting portion 343 defines a fixing groove 344 corresponding to the fixing arm 386.

Referring to FIG. 2, the lower cover 40 is matched with the upper cover 10 in shape. The lower cover 40 has a bottom board 41 and a second blocking wall 42 protruded upward from a periphery of the bottom board 41. Several portions of the bottom board 41 protrude upward to form a plurality of spaced hollow-shaped third fastening pillars 43 connecting with an inner periphery of the second blocking wall 42. Another several portions of the bottom board 41 protrude upward to form a plurality of spaced propping portions 44. A top of a rear end of the bottom board 41 is concaved downward to form a second recess 45 corresponding to the first recess 124. An inner periphery of a top of the second blocking wall 42 protrudes upward to form a blocking rib 46. A bottom surface of the bottom board 41 is connected with an arc-shaped handle 47.

Figure 6:
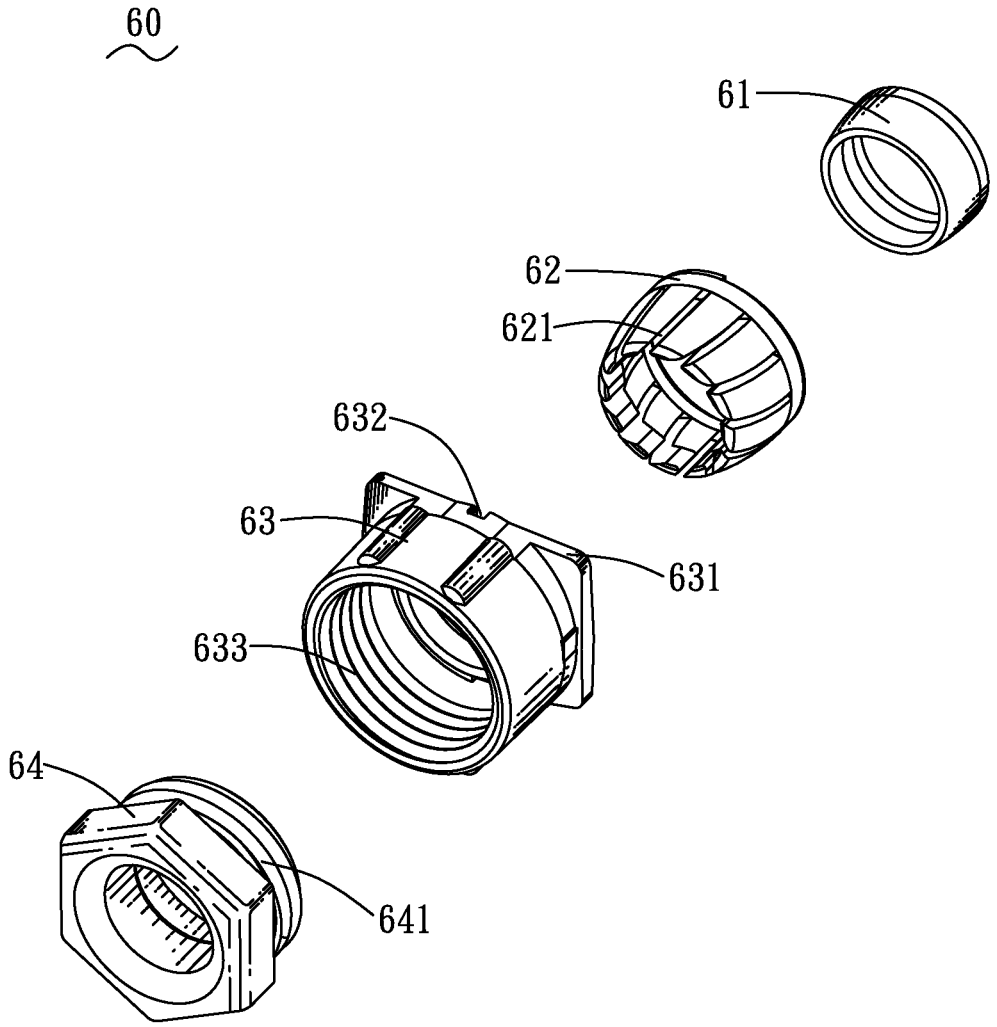
FIG. 6 is an exploded view of a clamping assembly of the rotatable plug of FIG. 3.
Figure 7:
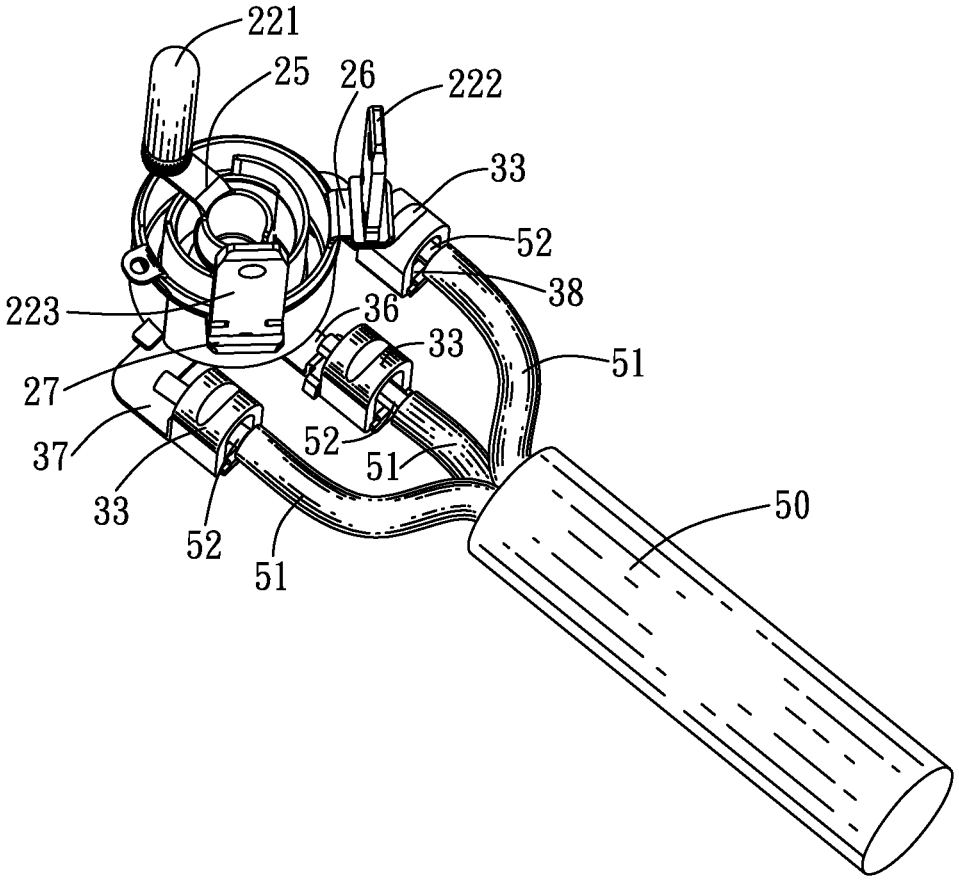
FIG. 7 is a partially perspective view of the rotatable plug of FIG. 1.
Figure 8:
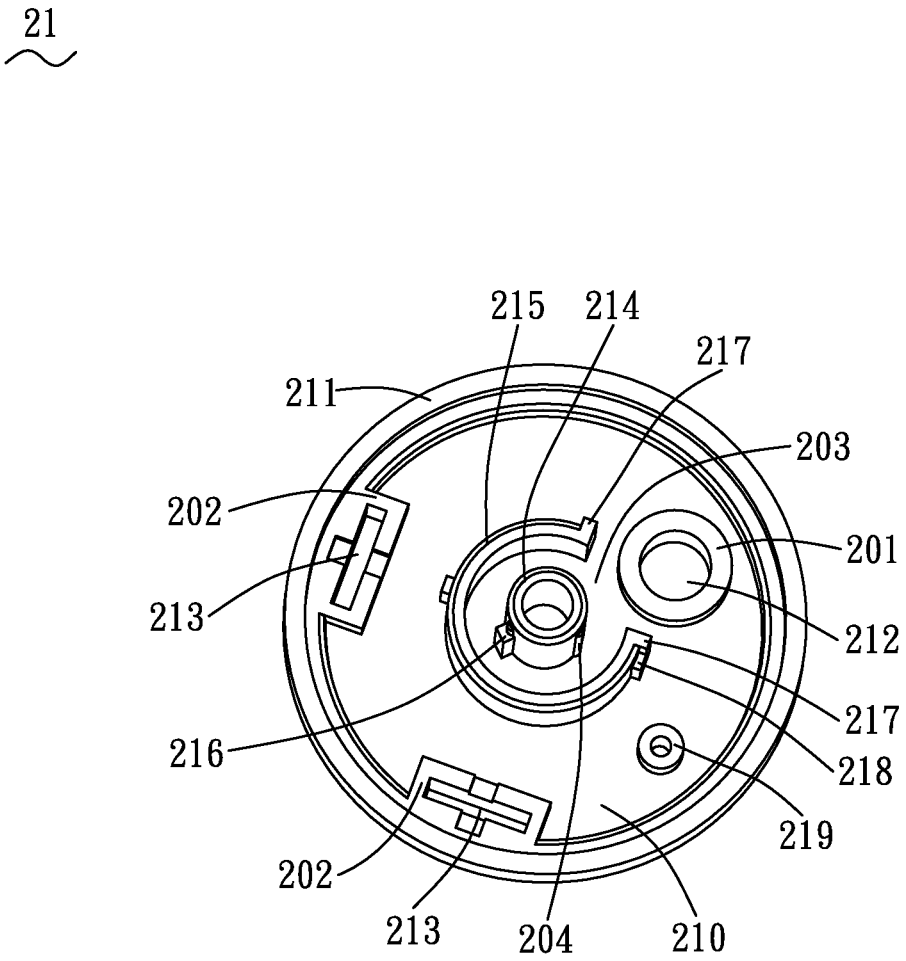
FIG. 8 is a perspective view of a terminal board of the rotatable plug of FIG. 1.
Figure 9:
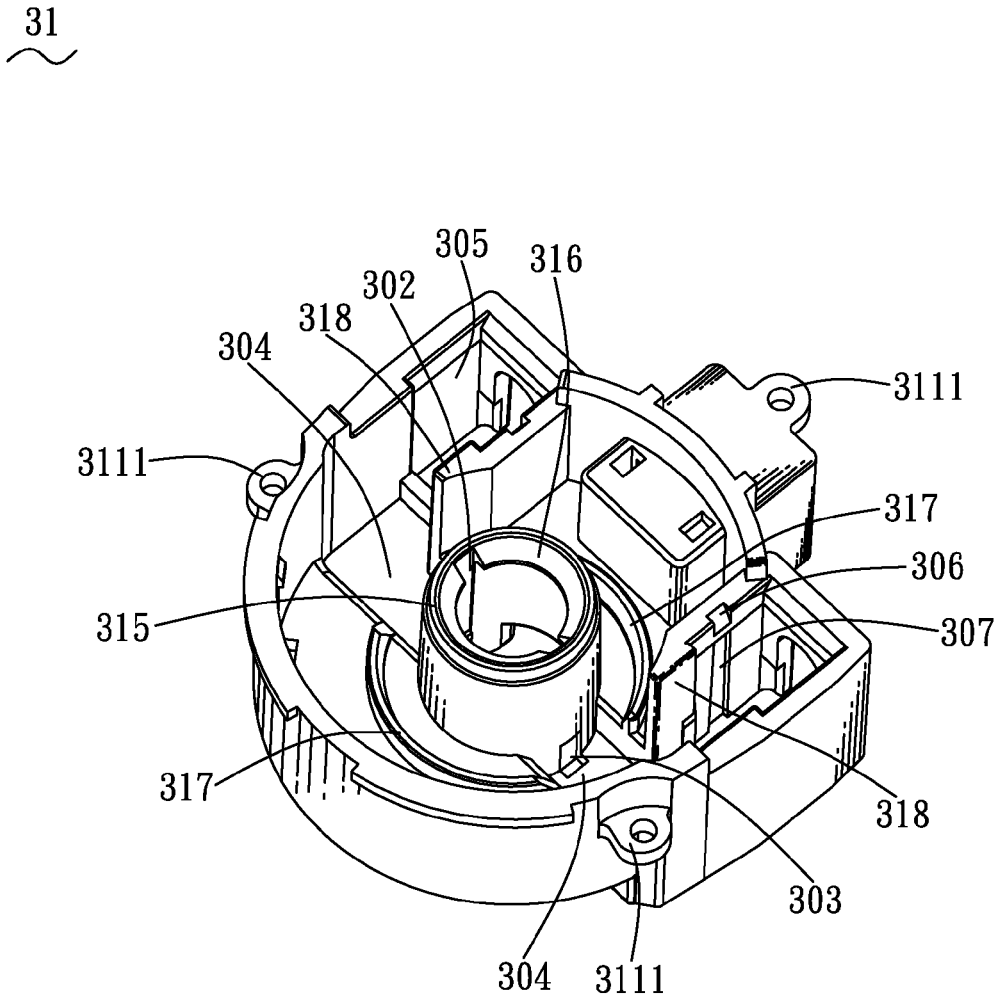
FIG. 9 is a perspective view of a base of the rotatable plug of FIG. 1.
Figure 10:
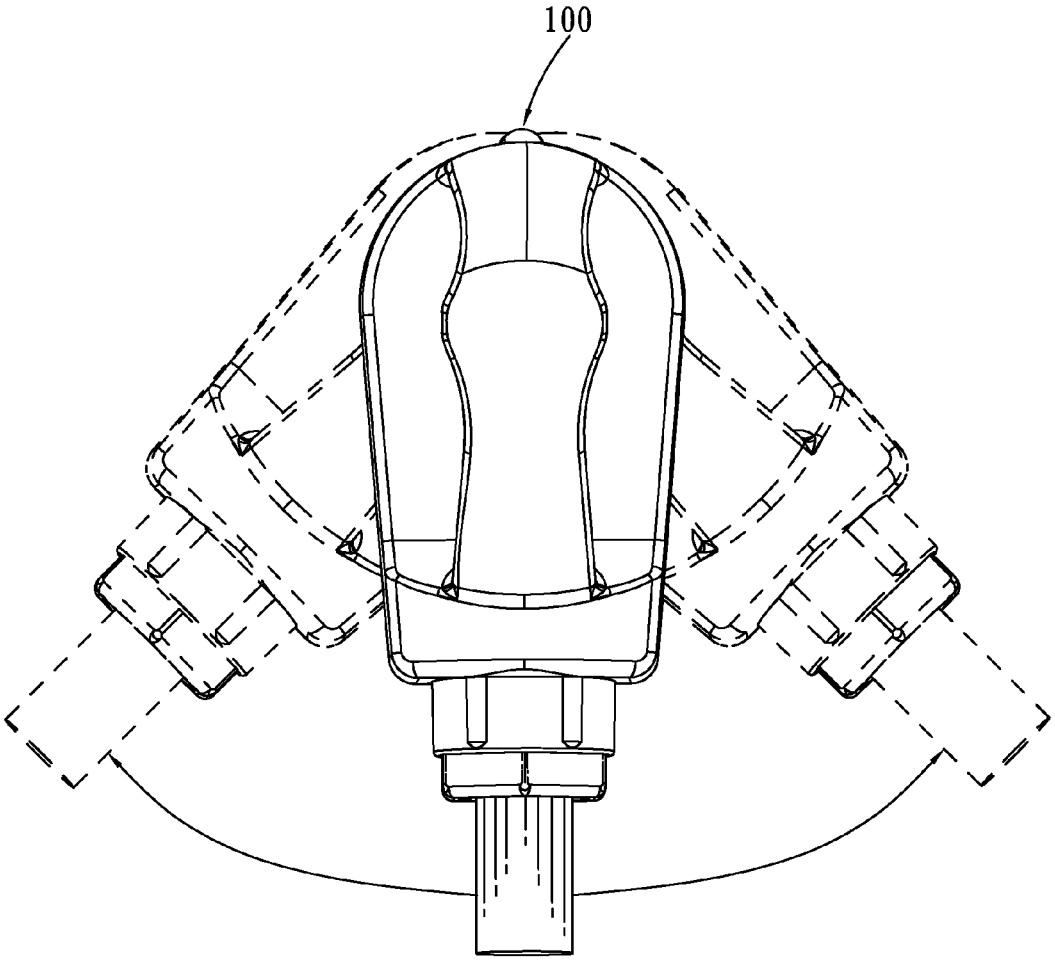
FIG. 10 is a perspective view showing rotating statuses of the rotatable plug of FIG. 1.

Referring to FIG. 2 and FIG. 6, the connecting cable 50 includes a plurality of core wires 51. A front end of each of the core wires 51 has a conductive portion 52. The clamping assembly 60 includes a fixing sleeve 61, a locking ring 62, a second fastening element 63 and a third fastening element 64. The locking ring 62 shows a hollow shape. A diameter of a front periphery of the locking ring 62 is larger than a diameter of a rear periphery of the locking ring 62. The rear end of the locking ring 62 defines a plurality of spaced notches 621. A front periphery of the second fastening element 63 protrudes outward to form a resisting portion 631. The second fastening element 63 defines a restricting groove 632 penetrating through a top and a front of the resisting portion 631. The second fastening element 63 and the third fastening element 64 show hollow shapes. A front end of an inner periphery of the second fastening element 63 defines a plurality of first threads 633. A rear end of an outer periphery of the third fastening element 64 defines a plurality of second threads 641.

Referring to FIG. 1 to FIG. 9, when the rotatable plug 100 is assembled, at first, the dynamic rotatable unit 20 is assembled. Specifically, the conductive pins 22 are fastened to the terminal board 21, and top ends of the conductive pins 22 project beyond a top of the terminal board 21. A bottom end of each of the conductive pins 22 projects under a bottom of the terminal board 21 and is fastened to a bottom of one end of one of the dynamic conductive tubes 23. Top ends of the ground wire pin 221, the neutral wire pin 222 and the live wire pin 223 project beyond the top of the terminal board 21 through the first insertion hole 212 and the second insertion holes 213 separately. Bottom ends of the ground wire pin 221, the neutral wire pin 222 and the live wire pin 223 are located under the bottom of the terminal board 21, and are fastened to a bottom of one end of the dynamic conductive tube of ground wire 25, a bottom of one end of the dynamic conductive tube of neutral wire 26 and a bottom of one end of the dynamic conductive tube of live wire 27 separately.

The ground wire pin 221 is inserted into the first insertion hole 212. The first insertion portion 206 passes through the first insertion hole 212 to project beyond a top of the first main board 210 of the terminal board 21. The first fastening portion 205 is fastened in the first insertion hole 212. The first contact portion 207 is located under the protruding pillar 201 of the terminal board 21. The neutral wire pin 222 and the live wire pin 223 are respectively inserted into the second insertion holes 213. The second insertion portions 225 respectively pass through the second insertion holes 213 to project beyond the top of the first main board 210 of the terminal board 21. The second fastening portions 224 are fastened in the second insertion holes 213. The second contact portions 226 of the neutral wire pin 222 and the live wire pin 223 are located under the protruding blocks 202 of the terminal board 21.

The dynamic conductive tubes 23 are fastened to the bottom of the terminal board 21 and are spaced from one another. The first rotatable ring 251 is disposed around an outside of the first supporting column 214 along the guiding pillars 204. A top sidewall of the first lacking groove 254 abuts against the first bearing portion 216. The first connecting piece 252 is disposed under the protruding pillar 201 of the terminal board 21, and the first connecting hole 253 is corresponding to the first insertion hole 212. The first contact portion 207 passes through the first connecting hole 253 to be fastened under the first connecting piece 252.

The dynamic conductive tube of neutral wire 26 is fastened to the bottom of the terminal board 21. The second rotatable ring 261 is disposed around the outside of the first supporting portion 215. The top periphery of the second rotatable ring 261 abuts against bottom surfaces of the second bearing portions 218. Two opposite sidewalls of the second lacking groove 264 abut against two side surfaces of the two first abutting portions 217. The second connecting piece 262 is disposed under one of the protruding blocks 202 of the terminal board 21, and the second connecting hole 263 is corresponding to one of the second insertion holes 213. The two second contact portions 226 of the neutral wire pin 222 pass through the second connecting hole 263 to be fastened under the corresponding second connecting piece 262.

The isolating ring 24 is fastened to the bottom of the terminal board 21, and the isolating ring 24 surrounds an outside of the second rotatable ring 261 of the dynamic conductive tube of neutral wire 26. The main body 241 surrounds the outside of the second rotatable ring 261. The locating piece 242 is disposed under the protruding pillar 201, the two rectangular protruding blocks 202 and the locating pillar 219. A front end of the first connecting piece 252 and the first contact portion 207 are respectively received in one of the holding grooves 244. A front end of the second connecting piece 262 is received in the other holding groove 244. The fourth connecting hole 275 is corresponding to the locating hole 246 and a middle of the locating pillar 219.

The dynamic conductive tube of live wire 27 is fastened to the bottom of the terminal board 21. The third rotatable ring 271 of the dynamic conductive tube of live wire 27 surrounds an outside of the isolating ring 24. The third connecting piece 272 passes through the locating groove 245 to be disposed under the other protruding block 202 of the terminal board 21, and the third connecting hole 274 is corresponding to the other second insertion hole 213. The second contact portions 226 of the live wire pin 223 pass through the third connecting hole 274 to be fastened under the third connecting piece 272. The fourth connecting piece 273 is disposed under the protruding pillar 201 of the terminal board 21, and the first fastening element 28 passes through the fourth connecting hole 275, the locating hole 246 and the middle of the locating pillar 219 to fasten the isolating ring 24, the dynamic conductive tube of live wire 27, the dynamic conductive tube of neutral wire 26 and the dynamic conductive tube of ground wire 25 to the bottom of the terminal board 21.

Secondly, the static rotatable unit 30 is assembled. Specifically, the static conductive tubes 32 are fastened to the base 31 and are spaced from one another. The first contact arm 363, the second contact arm 373 and the third contact arm 383 pass through three middles of the three wire clamps 33 separately, and then the first contact arm 363, the second contact arm 373 and the third contact arm 383 together with the wire clamps 33 are assembled to the receiving grooves 308 separately.

The static conductive tube of ground wire 36 is fastened to the base 31. The first ring body 361 is assembled inside the second supporting ring 315, and a top periphery of the first ring body 361 abuts against a bottom of the third abutting portion 316. The buckling portions 367 are buckled in the buckling grooves 302. The first connecting arm 362 is located under the second main board 310. The first contact arm 363 passes through the middle of the wire clamp 33, and the first contact arm 363 together with the wire clamp 33 is assembled to the receiving groove 308 located at the middle of the rear end of the base 31. The two first fastening arms 364 abut against two opposite sidewalls of the receiving groove 308. Two opposite sides of the first blocking arm 365 abut against two inner surfaces of two opposite sides of a front sidewall of the receiving groove 308.

The static conductive tube of neutral wire 37 is fastened to the base 31. The second ring body 371 is accommodated in the accommodating space 314 and surrounds the second supporting ring 315. The second fastening arm 374 is fastened in the fastening groove 303. The second connecting arm 372 is assembled to one of the assembling grooves 304. The second contact arm 373 passes through the middle of the wire clamp 33, and the second contact arm 373 together with the wire clamp 33 is assembled to the receiving groove 308 located at one side of the rear end of the base 31. Two opposite sides of the second blocking arm 375 abut against two inner surfaces of two opposite sides of a front sidewall of the receiving groove 308 located at one side of the rear end of the base 31.

The static conductive tube of live wire 38 is fastened to the base 31. The third ring body 381 is accommodated in the accommodating space 314 and is disposed around the two second supporting portions 317. The third connecting arm 382 is assembled to the other assembling groove 304. The third contact arm 383 passes through the middle of the wire clamp 33, and the third contact arm 383 together with the wire clamp 33 is assembled to the receiving groove 308 located at the other side of the rear end of the base 31. Two opposite sides of the third blocking arm 384 abut against two inner surfaces of two opposite sides of a front sidewall of the receiving groove 308 located at the other side of the rear end of the base 31. The fixing arm 386 is accommodated in the accommodating space 314. Each of the locking elements 35 passes through the locking hole 331 of one of the wire clamps 33 to be located under the first contact arm 363, the second contact arm 373 and the third contact arm 383 separately.

The sealing element 34 is assembled in the base 31, and is accommodated in the accommodating space 314. The guiding portions 342 are slid into the guiding channels 307 along the guiding grooves 306 to guide the restraining portions 341 to be fastened in the restraining grooves 305. The limiting portion 343 is located in front of the wire clamp 33. The fixing arm 386 is fixed in the fixing groove 344. The two limiting blocks 309 is located above the sealing portion 340 to limit the sealing element 34 in the accommodating space 314.

Again, the dynamic rotatable unit 20 is pivotally mounted to the static rotatable unit 30. The static rotatable unit 30 is pivotally mounted to a bottom of the dynamic rotatable unit 20 and is fastened to an inside of the lower cover 40. Specifically, the blocking portion 211 of the terminal board 21 is disposed on the top surface of the connecting wall 313 and the top surface of the front end of the surrounding wall 311. The first supporting column 214 and the first rotatable ring 251 of the dynamic conductive tube of ground wire 25 are together assembled in the first ring body 361 of the static conductive tube of ground wire 36. The first ring body 361 surrounds and is electrically connected with an outside of the first rotatable ring 251. The first supporting portion 215 is assembled between the first ring body 361 and the second ring body 371 of the static conductive tube of neutral wire 37. The second rotatable ring 261 surrounds and is electrically connected with an outside of the second ring body 371. The third rotatable ring 271 and the ring-shaped main body 241 of the isolating ring 24 are together assembled between the second ring body 371 and the third ring body 381 of the static conductive tube of live wire 38. The third ring body 381 surrounds and is electrically connected with an outside of the third rotatable ring 271.

The connecting cable 50 is fastened to the static rotatable unit 30. Specifically, the conductive portions 52 of the core wires 51 of the connecting cable 50 separately project into the receiving grooves 308 to be located above the first contact arm 363, the second contact arm 373 and the third contact arm 383. The locking elements 35 pass through the locking holes 331 of the wire clamps 33 to lock the conductive portions 52 of the core wires 51 between the first contact arm 363 and the corresponding wire clamp 33, between the second contact arm 373 and the corresponding wire clamp 33, and between the third contact arm 383 and the corresponding wire clamp 33, so that the conductive portions 52 of the core wires 51 electrically contact the first touching points 366 of the first contact arm 363, the second touching points 376 of the second contact arm 373 and the third touching points 385 of the third contact arm 383 separately.

The clamping assembly 60 clamps the connecting cable 50. Specifically, the fixing sleeve 61 is mounted around an outside of the connecting cable 50. The locking ring 62 locks an outside of the fixing sleeve 61. The second fastening element 63 is fastened to an outside of the locking ring 62. The third fastening element 64 is screwed into the second fastening element 63. The second threads 641 are engaged with the first threads 633 to make the third fastening element 64 fastened into the second fastening element 63 and the third fastening element 64 fastened to a rear end of the outside of the locking ring 62.

At last, the upper cover 10 is covered on the dynamic rotatable unit 20, the static rotatable unit 30, the connecting cable 50 and the clamping assembly 60. The blocking portion 211 is blocked against a bottom of a sidewall of the opening 111. The top ends of the conductive pins 22 are exposed out of the upper cover 10 through the opening 111. The first insertion portion 206 and each second insertion portion 225 are exposed out of the upper cover 10 through the opening 111. A middle of each of the fastening rings 3111 is corresponding to a middle of one of the first fastening pillars 122. The restricting block 125 is restricted in the restricting groove 632.

The rotatable plug 100 further includes a plurality of fourth fastening elements 70 and a plurality of fifth fastening elements 80. The fourth fastening elements 70 pass through the middles of the first fastening pillars 122 and the fastening rings 3111 to fasten the static rotatable unit 30 together with the dynamic rotatable unit 20 to the upper cover 10. The lower cover 40 is fastened under the upper cover 10 to make the dynamic rotatable unit 20, the static rotatable unit 30, the front end of the connecting cable 50 and the front end of the clamping assembly 60 located between the upper cover 10 and the lower cover 40. A middle of each of the second fastening pillars 123 is corresponding to a middle of one of the third fastening pillars 43. A rear end of the connecting cable 50 projects out of the upper cover 10 and the lower cover 40.

Each of the fifth fastening elements 80 passes through the middle of one of the second fastening pillars 123 and the middle of one of the third fastening pillars 43 to fasten the upper cover 10 to the lower cover 40. The blocking rib 46 is blocked in the blocking groove 121. Simultaneously, the dynamic rotatable unit 20, the static rotatable unit 30, a font end of the connecting cable 50 and a front end of the clamping assembly 60 are fastened between the upper cover 10 and the lower cover 40. The first recess 124 is corresponding to the second recess 45. The propping portions 44 prop up a bottom of the base 31. The rear end of the connecting cable 50 and a rear end of the clamping assembly 60 pass through the first recess 124 and the second recess 45 to project out of the upper cover 10 and the lower cover 40. A top end of the resisting portion 631 is blocked against a rear surface of a sidewall of the first recess 124, and a bottom end of the resisting portion 631 is blocked against a rear surface of a sidewall of the second recess 45. So the clamping assembly 60 clamps the connecting cable 50 and is fastened to the upper cover 10 and the lower cover 40.

Referring to FIG. 1 to FIG. 10, when the rotatable plug 100 is unused, the dynamic rotatable unit 20 is capable of being rotated to make the first rotatable ring 251 of the dynamic conductive tube of ground wire 25 rotate 360 degrees around the first ring body 361 of the static conductive tube of ground wire 36, make the second ring body 371 rotate 360 degrees around the second rotatable ring 261, and make the third rotatable ring 271 rotate 360 degrees around the third ring body 381 so that the dynamic rotatable unit 20 is capable of rotating to the required angle. The upper cover 10, the static rotatable unit 30, the lower cover 40 and the clamping assembly 60 are capable of rotating 360 degrees along a traction direction of the connecting cable 50. Simultaneously, the first ring body 361 of the static conductive tube of ground wire 36 rotates 360 degrees around the first rotatable ring 251 of the dynamic conductive tube of ground wire 25, and the second rotatable ring 261 rotates 360 degrees around the second ring body 371 and the third ring body 381 rotates 360 degrees around the third rotatable ring 271. And the upper cover 10, the static rotatable unit 30, the lower cover 40, the clamping assembly 60 and the connecting cable 50 are capable of proceeding the same angle rotation.

Referring to FIG. 1 to FIG. 10, when the rotatable plug 100 is in use, after the rotatable plug 100 is inserted into a socket (not shown), the first insertion portion 206 and each second insertion portion 225 are inserted into the socket, the socket is immovable and the rotatable plug 100 is fastened to the socket. In order to achieve a use convenience, it is often needed to twist the connecting cable 50 of the rotatable plug 100. The upper cover 10, the static rotatable unit 30, the lower cover 40 and the clamping assembly 60 are capable of rotating 360 degrees along the traction direction of the connecting cable 50. Simultaneously, the first ring body 361 of the static conductive tube of ground wire 36 rotates 360 degrees around the first rotatable ring 251 of the dynamic conductive tube of ground wire 25, and the second rotatable ring 261 rotates 360 degrees around the second ring body 371 and the third ring body 381 rotates 360 degrees around the third rotatable ring 271. And the upper cover 10, the static rotatable unit 30, the lower cover 40, the clamping assembly 60 and the connecting cable 50 are capable of proceeding the same angle rotation. When the upper cover 10, the static rotatable unit 30, the lower cover 40 and the clamping assembly 60 are rotated, the handle 47 is capable of being pulled upward to rotate the lower cover 40 for bringing along the upper cover 10, the static rotatable unit 30 and the clamping assembly 60 to rotate together.

When it is needed to pull out the rotatable plug 100, the handle 47 is capable of being pulled upward for making the rotatable plug 100 pulled out successfully.

As described above, the upper cover 10, the static rotatable unit 30, the lower cover 40 and the clamping assembly 60 are capable of rotating 360 degrees along the traction direction of the connecting cable 50, and the upper cover 10, the static rotatable unit 30, the lower cover 40, the clamping assembly 60 and the connecting cable 50 are capable of proceeding the same angle rotation. So that it's easier to keep the connecting cable 50 connected with the static rotatable unit 30 in good shape for ensuring an electrical performance stability and a usage convenience of the rotatable plug 100.

What is claimed is:

1. A rotatable plug, comprising:

an upper cover including a top board, a front end of the top board defining an opening vertically penetrating through the front end of the top board;

a dynamic rotatable unit including a terminal board, a plurality of conductive pins and a plurality of dynamic conductive tubes, the conductive pins being fastened to the terminal board, and top ends of the conductive pins projecting beyond a top of the terminal board, the dynamic conductive tubes being fastened to a bottom of the terminal board and being spaced from one another, each of the dynamic conductive tubes having a rotatable ring, a bottom end of each of the conductive pins projecting under the bottom of the terminal board and being fastened to a bottom of one end of one of the dynamic conductive tubes;

a static rotatable unit pivotally mounted to a bottom of the dynamic rotatable unit, the static rotatable unit including a base and a plurality of static conductive tubes, the static conductive tubes being fastened to the base and being spaced from one another, each of the static conductive tubes having a ring body, the rotatable ring of each of the dynamic conductive tubes being disposed around and being electrically connected with the ring body of one of the static conductive tubes, wherein the dynamic rotatable unit is mounted and rotates in connection with the static rotatable unit;

a connecting cable fastened to the static rotatable unit, the upper cover covering the dynamic rotatable unit, the static rotatable unit and the connecting cable, the top ends of the conductive pins being exposed out of the upper cover through the opening, wherein ground, neutral, and active wires of the connecting cable are electrically connected to the respective static conductive tubes; and a lower cover fastened under the upper cover to make the dynamic rotatable unit, the static rotatable unit and a front end of the connecting cable fastened between the upper cover and the lower cover, a rear end of the connecting cable projecting out of the upper cover and the lower cover, wherein the upper cover, the static rotatable unit and the lower cover are capable of rotating 360 degrees along a traction direction of the connecting cable, and the upper cover, the static rotatable unit, the lower cover and the connecting cable are capable of proceeding in the same angle of rotation.

2. The rotatable plug as claimed in claim 1, wherein the terminal board defines a first insertion hole and two second insertion holes, the conductive pins include a ground wire pin, a neutral wire pin and a live wire pin of which top ends project beyond the top of the terminal board through the first insertion hole and the second insertion holes separately, the dynamic conductive tubes include a dynamic conductive tube for a ground wire, a dynamic conductive tube for a neutral wire and a dynamic conductive tube for a live wire, bottom ends of the ground wire pin, the neutral wire pin and the live wire pin are located under the bottom of the terminal board, and are fastened to a bottom of one end of the dynamic conductive tube for a ground wire, a bottom of one end of the dynamic conductive tube for a neutral wire and a bottom of one end of the dynamic conductive tube for a live wire separately.

3. The rotatable plug as claimed in claim 2, wherein the dynamic conductive tube for a ground wire has a first rotatable ring, the dynamic conductive tube for a neutral wire has a second rotatable ring, the dynamic conductive tube for a live wire has a third rotatable ring, the static conductive tubes include a static conductive tube for a ground wire, a static conductive tube for a neutral wire and a static conductive tube for a live wire, the static conductive tube for a ground wire has a first ring body, the static conductive tube for a neutral wire has a second ring body, the static conductive tube for a live wire has a third ring body, the first ring body surrounds and is electrically connected with an outside of the first rotatable ring, the second rotatable ring surrounds and is electrically connected with an outside of the second ring body, the third ring body surrounds and is electrically connected with an outside of the third rotatable ring.

4. The rotatable plug as claimed in claim 3, wherein the terminal board has a first main board, a bottom surface of the first main board protrudes downward to form a hollow-shaped first supporting column, and a semicircular-shaped first supporting portion disposed around and spaced from the first supporting column, the first rotatable ring is disposed around an outside of the first supporting column, the second rotatable ring is disposed around an outside of the first supporting portion, the dynamic rotatable unit further includes an isolating ring fastened to the bottom of the terminal board, and the isolating ring surrounds an outside of the second rotatable ring, the third rotatable ring surrounds an outside of the isolating ring, the first supporting column and the first rotatable ring are together assembled in the first ring body, the first supporting portion is assembled between the first ring body and the second ring body, the third rotatable ring and the isolating ring are together assembled between the second ring body and the third ring body.

5. The rotatable plug as claimed in claim 4, wherein two opposite sides and a rear end of the first supporting column protrude outward to form a plurality of guiding pillars, an upper portion of one of the guiding pillars located at the rear end of the first supporting column protrudes outward to form a first bearing portion, a rear end of a top periphery of the first rotatable ring is recessed downward to form a first lacking groove, the first rotatable ring is disposed around the outside of the first supporting column along the guiding pillars, a top sidewall of the first lacking groove abuts against the first bearing portion.

6. The rotatable plug as claimed in claim 4, wherein two free ends of the outside of the first supporting portion protrude outward to form two first abutting portions, two portions of the outside of the first supporting portion protrude outward to form two second bearing portions, a front end of a top periphery of the second rotatable ring is recessed downward to form a second lacking groove, the top periphery of the second rotatable ring abuts against bottom surfaces of the second bearing portions, two opposite sidewalls of the second lacking groove abut against two side surfaces of the two first abutting portions.

7. The rotatable plug as claimed in claim 4, wherein the ground wire pin has a first fastening portion, and a first contact portion protruded downward from a bottom end of the first fastening portion, the dynamic conductive tube for a ground wire has a first connecting piece extended outward from a top periphery of the first rotatable ring, the first connecting piece opens a first connecting hole, the first contact portion is located under the terminal board, the first connecting piece is disposed under the terminal board, the first contact portion passes through the first connecting hole to be fastened under the first connecting piece.

8. The rotatable plug as claimed in claim 7, wherein the neutral wire pin and the live wire pin have the same structure, and respectively have an elongated second fastening portion, and two second contact portions protruded downward from two opposite sides of a bottom end of the second fastening portion, the dynamic conductive tube for a neutral wire has a second connecting piece extended outward from one side of a rear end of a top periphery of the second rotatable ring, the second connecting piece opens a second connecting hole, the dynamic conductive tube for a live wire has a third connecting piece extended outward from one side of a rear end of a top periphery of the third rotatable ring, the third connecting piece opens a third connecting hole, the second contact portions are located under the terminal board, the second connecting piece and the third connecting piece are disposed under the terminal board, the two second contact portions of the neutral wire pin pass through the second connecting hole to be fastened under the corresponding second connecting piece, the second contact portions of the live wire pin pass through the third connecting hole to be fastened under the third connecting piece.

9. The rotatable plug as claimed in claim 8, wherein one side of the bottom surface of the first main board protrudes downward to form a hollow-shaped locating pillar, the dynamic conductive tube for a live wire has a fourth connecting piece extended outward from the other side of the rear end of the top periphery of the third rotatable ring, the fourth connecting piece opens a fourth connecting hole, the isolating ring has a ring-shaped main body, and a semicircular locating piece protruded outward from a top edge of the main body, two opposite sides of the locating piece protrude downward to form two holding portions, a top surface of each of the holding portions is concaved downward to form a holding groove, a locating groove is formed between two free ends of the locating piece, the locating piece opens a locating hole, a front end of the first connecting piece and the first contact portion are respectively received in one of the holding grooves, a front end of the second connecting piece is received in the other holding groove, the third connecting piece passes through the locating groove to be disposed under the terminal board, the fourth connecting hole is corresponding to the locating hole and a middle of the locating pillar, a first fastening element passes through the fourth connecting hole, the locating hole and the middle of the locating pillar to fasten the isolating ring, the dynamic conductive tube for a live wire, the dynamic conductive tube for a neutral wire and the dynamic conductive tube for a ground wire to the bottom of the terminal board.

10. The rotatable plug as claimed in claim 3, wherein the base has a second main board, a middle of the second main board opens a fastening hole, a periphery of a sidewall of the fastening hole protrudes upward to form a cylindrical second supporting ring, a front end and a rear end of the second main board protrude upward to form two second supporting portions, the first ring body is assembled inside the second supporting ring, the second ring body surrounds the second supporting ring, the third ring body is disposed around the two second supporting portions.

11. The rotatable plug as claimed in claim 10, wherein a top of an inner periphery of the second supporting ring protrudes inward to form a ring-shaped third abutting portion, two opposite sides of the inner periphery of the second supporting ring are recessed oppositely to form two buckling grooves vertically penetrating through two opposite sides of the third abutting portion, one side of a bottom end of an outer periphery of the second supporting ring opens a fastening groove, the static rotatable unit further includes a sealing element assembled in the base, a bottom of each free end of the sealing portion extends downward to form a limiting portion of which a bottom defines a fixing groove, two opposite sides of the first ring body are punched outward to form two buckling portions, the static conductive tube for a neutral wire has a second connecting arm extended downward, then extended outward, and further bent rearward and extended upward from a bottom periphery of the second ring body, one end of the second connecting arm adjacent to the second ring body is punched inward to form a second fastening arm, a bottom periphery of the third ring body is bent outward to form a fixing arm, the buckling portions are buckled in the buckling grooves, the second fastening arm is fastened in the fastening groove, the fixing arm is fixed in the fixing groove.

12. The rotatable plug as claimed in claim 10, wherein a rear end of the base defines a plurality of receiving grooves, the static conductive tube for a ground wire has a first connecting arm connecting with a rear end of a bottom periphery of the first ring body, and a first contact arm extended rearward from a free end of the first connecting arm, the static conductive tube for a neutral wire has a second contact arm extended rearward from a free end of the second connecting arm, the static conductive tube for a live wire has a third connecting arm extended downward and outward, then bent rearward, and further extended upward from a bottom periphery of the third ring body, and a third contact arm extended rearward from a free end of the third connecting arm, the static rotatable unit includes a plurality of hollow-shaped wire clamps and a plurality of locking elements, the first contact arm, the second contact arm and the third contact arm pass through three middles of the three wire clamps separately, and then the first contact arm, the second contact arm and the third contact arm together with the wire clamps are assembled to the receiving grooves separately, each of the locking elements passes through the locking hole of one of the wire clamps to be located under the first contact arm, the second contact arm and the third contact arm separately, conductive portions of core wires of the connecting cable separately project into the receiving grooves to be located above the first contact arm, the second contact arm and the third contact arm.

13. The rotatable plug as claimed in claim 1, further comprising a clamping assembly clamping the connecting cable and fastened to the upper cover and the lower cover, the clamping assembly including a fixing sleeve mounted around an outside of the connecting cable, a locking ring locking an outside of the fixing sleeve, a second fastening element fastened to an outside of the locking ring, and a third fastening element fastened into the second fastening element and fastened to a rear end of the outside of the locking ring.

* * * * *